US010464335B1

(12) United States Patent
Lo

(10) Patent No.: US 10,464,335 B1
(45) Date of Patent: Nov. 5, 2019

(54) INK LEVEL DETECTING DEVICE OF INK SUPPLY SYSTEM

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Wen-Chung Lo, New Taipei (TW)

(73) Assignees: HUNG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/100,625

(22) Filed: Aug. 10, 2018

(30) Foreign Application Priority Data

Apr. 25, 2018 (CN) ..... 2018 1 0380414

(51) Int. Cl.
*B41J 2/175* (2006.01)

(52) U.S. Cl.
CPC .. *B41J 2/17566* (2013.01); *B41J 2002/17573* (2013.01)

(58) Field of Classification Search
CPC ..... B41J 2/17566; B41J 2002/17573
See application file for complete search history.

(56) References Cited

U.S. PATENT DOCUMENTS

2012/0194582 A1* 8/2012 Matsubara ..... B41J 2/17566 347/7
2018/0015726 A1* 1/2018 Aoyagi ..... A61J 3/06

* cited by examiner

*Primary Examiner* — Scott A Richmond
(74) *Attorney, Agent, or Firm* — ScienBiziP, P.C.

(57) ABSTRACT

An ink level detecting device rotationally coupled to an ink reservoir of an ink supply system is configured to detect an ink level of the ink reservoir. When an ink level of the ink reservoir is greater than a predetermined level, a weight distribution of the ink reservoir and the ink is toward a first side of the rotating portion. When the ink level of the ink reservoir is less than the predetermined level, the weight distribution of the ink reservoir and the ink is toward a second side of the rotating portion opposite to the first side.

16 Claims, 2 Drawing Sheets

INK LEVEL DETECTING DEVICE OF INK SUPPLY SYSTEM

FIELD

The subject matter herein generally relates to printers, and more particularly to an ink supply system including an ink level detecting device for detecting an ink level of an ink reservoir.

BACKGROUND

Generally, printers that use ink for printing require an ink reservoir to be filled/refilled when an ink level of the ink reservoir is low. When ink level of the ink reservoir is low or empty, then the ink will not be sufficient to be supplied to a print head to continue to print and may cause the ink supply system of the printer to fail.

BRIEF DESCRIPTION OF THE DRAWINGS

Implementations of the present disclosure will now be described, by way of example only, with reference to the attached figures.

DETAILED DESCRIPTION

Figure 1:
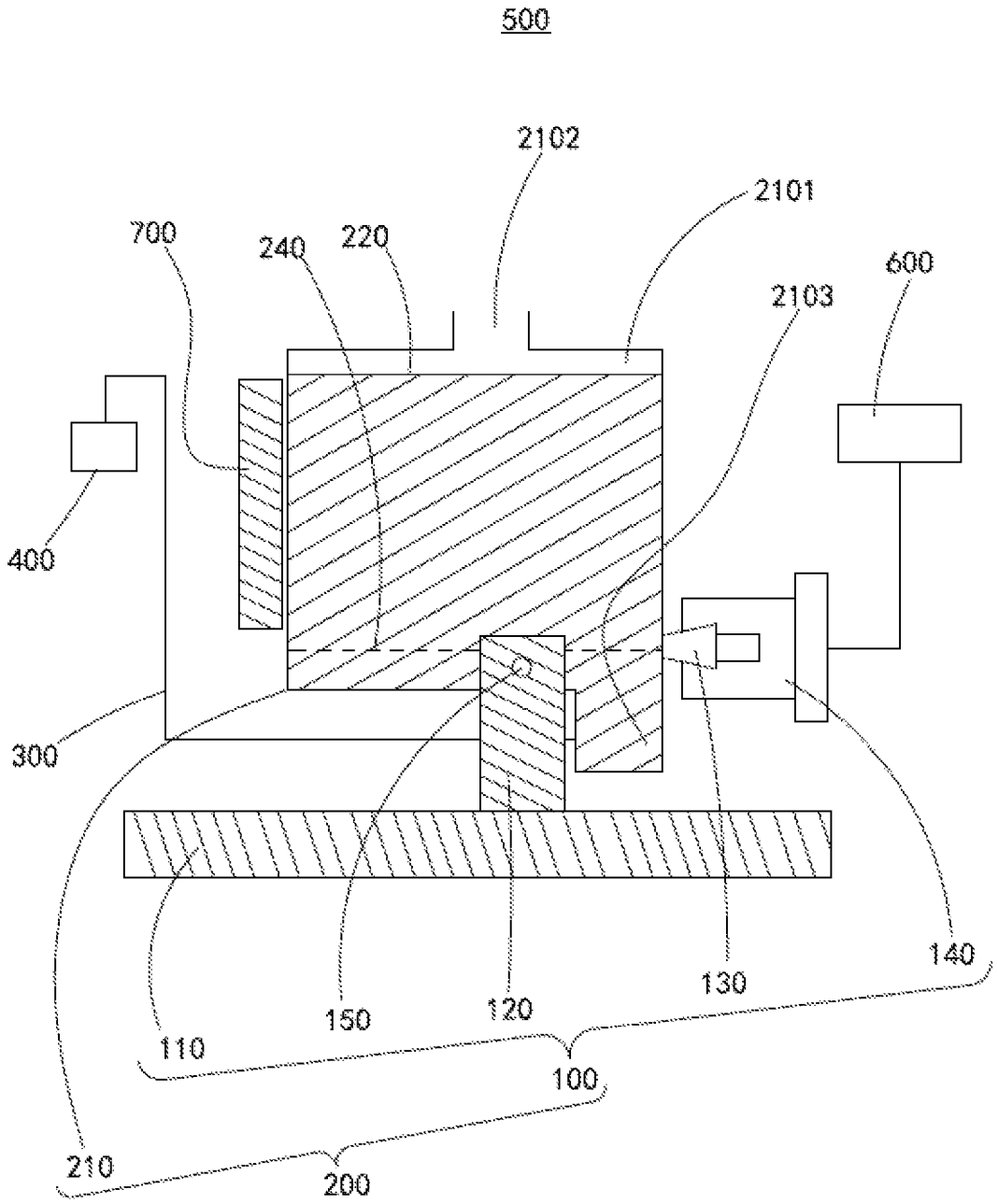
FIG. 1 is a diagram of an embodiment of an ink supply system in accordance with an embodiment of the present disclosure, showing an ink reservoir with an ink level at a first level.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
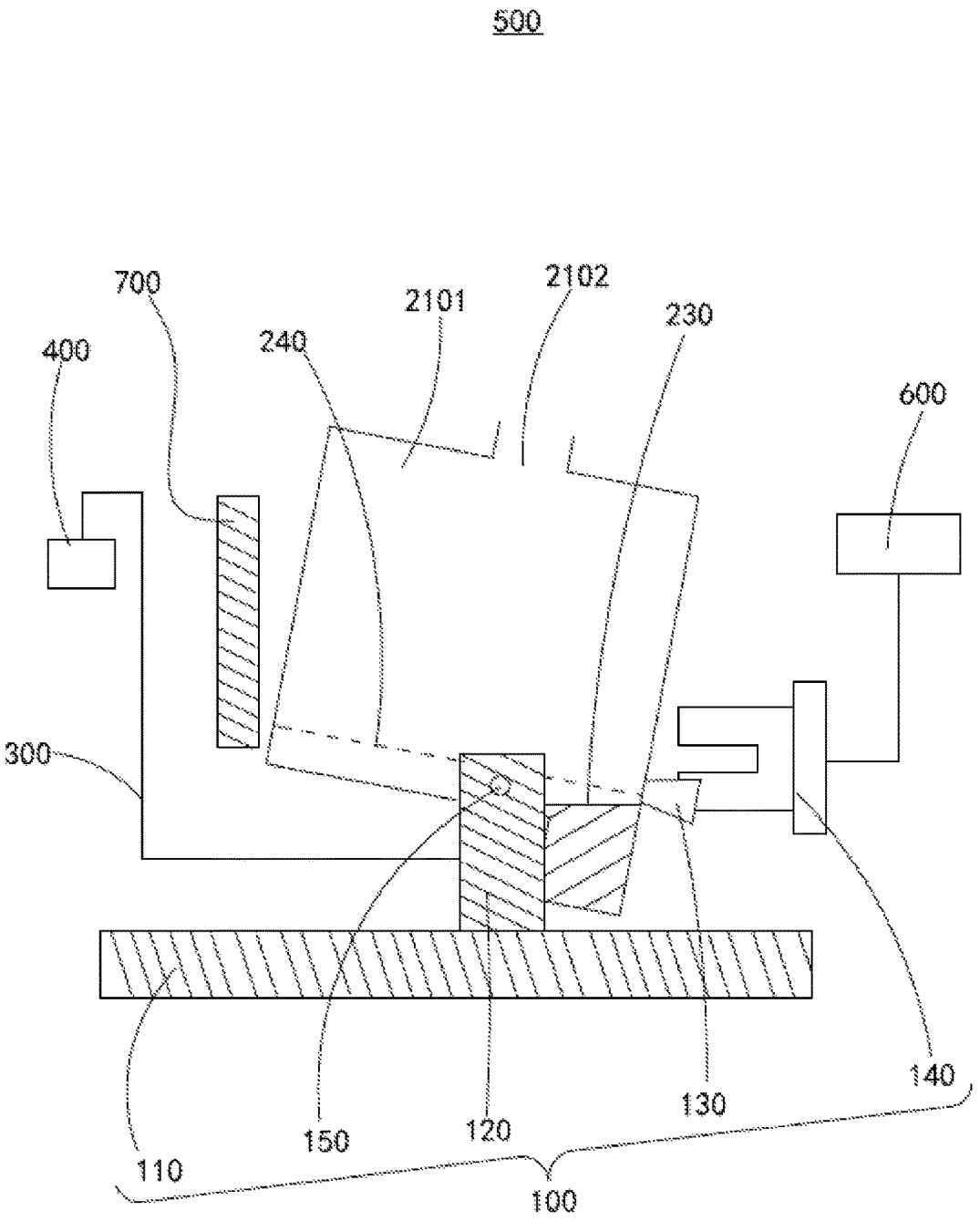
FIG. 2 is similar to FIG. 1, but shows the ink reservoir with an ink level at a second level.

FIG. 1 and FIG. 2 illustrate an embodiment of an ink supply system 500 including an ink reservoir module 200, an ink supply line 300, and a controller 600.

The ink reservoir module 200 includes an ink reservoir 210 and an ink level detecting device 100. The ink reservoir 210 stores ink. The ink level detecting device 100 is rotationally coupled to the ink reservoir 210 and detects an ink level of the ink reservoir 210.

The ink supply line 300 is coupled between the ink reservoir 210 and a print head 400.

The controller 600 is in communication with the ink level detecting device 100. When an ink level of the ink reservoir 210 is less than a predetermined amount, the controller 600 controls the print head 400 to turn off.

The ink level detecting device 100 includes a base 110, a support 120, a rotating portion 150, an indicating unit 130, and a sensing unit 140.

The support 120 is fixed to an upper portion of the base 110. The support 120 supports the ink reservoir 210.

The rotating portion 150 is fixed to the support 120 and rotationally couples the support 120 to the ink reservoir 210.

The indicating unit 130 is fixed to an outer surface of the ink reservoir 210 and rotates along with the ink reservoir 210. The sensing unit 140 corresponds to the indicating unit 130 and senses a change in position of the indicating unit 130.

When an ink level of the ink reservoir 210 is greater than a predetermined amount, a weight distribution of the ink reservoir 210 and the ink is toward a first side of the rotating portion 150. When the ink level of the ink reservoir 210 is less than the predetermined amount, the weight distribution of the ink reservoir 210 and the ink is toward a second side of the rotating portion 150 opposite to the first side.

For example, when the ink reservoir 210 is rotationally coupled to the support 120, a warning level 240 can be set. The warning level 240 is the predetermined level of ink. When the ink level of the ink reservoir 210 is at a first level 220 greater than the warning level 240, the weight distribution of the ink reservoir 210 and the ink is toward the first side of the rotating portion 150 (shown in FIG. 1). When the ink level of the ink reservoir is at a second level 230 less than the warning level 240, the weight distribution of the ink reservoir 210 and the ink is toward the second side of the rotating portion 150 (shown in FIG. 2).

The indicating unit 130 is fixed to the outer surface of the ink reservoir 210 and rotates along with the ink reservoir 210. Thus, when the indicating unit 130 is rotated toward the first side or the second side, the sensing unit 140 senses the change in position of the indicating unit 130 to determine whether the ink level of the ink reservoir 210 is less than the warning level 240.

In detail, the ink supply system 500 further includes a stop unit 700. When the ink level of the ink reservoir 210 is greater than the predetermined level, the weight distribution of the ink reservoir 210 and the ink is toward the first side of the rotating portion 150, and the ink reservoir 210 resists against the stop portion 700 to limit rotation of the ink reservoir 210.

In at least one embodiment, the ink level detecting device 100 further includes a counterweight 2103. The counterweight 2103 is coupled to a bottom side of the ink reservoir 210 adjacent to the second side.

When the ink level of the ink reservoir 210 is less than the predetermined level, the counterweight 2103, under the influence of gravity, rotates the ink reservoir 210 toward the second side.

The ink reservoir 210 defines a chamber 2101, an ink filling port 2102, and a rotation coupling portion (not shown).

The chamber 2101 receives the ink. The ink filling port 2102 is coupled to an upper part of the chamber 2101. The rotation coupling portion is arranged at a bottom portion of the ink reservoir 210 adjacent to the second side.

The ink reservoir 210 is rotationally coupled to the rotating portion 150 by the rotation coupling portion.

For example, the counterweight 2103 is hollow and coupled to the bottom portion of the ink reservoir 210. When the ink level of the ink reservoir 210 is less than the predetermined level, the ink received in the counterweight 2103, due to gravity, rotates the ink reservoir 210 toward the second side.

The sensing unit 140 may be a light blocking sensor.

When the ink level of the ink reservoir 210 is greater than the predetermined level, the weight distribution of the ink reservoir 210 and the ink is toward the first side of the rotating portion 150, and the indicating unit 130 blocks the sensing unit 140.

When the ink level of the ink reservoir 210 is less than the predetermined level, the weight distribution of the ink reservoir and the ink is toward the second side of the rotating portion 150, and the indicating unit 130 is moved away from the sensing unit 140.

In at least one embodiment, the ink level detecting device 100 further includes a warning unit (not shown). The warning unit is in communication with the sensing unit 140.

When the indicating unit 130 is moved away from the sensing unit 140, the warning unit emits a warning signal.

In the ink supply system described above, when the ink level of the ink reservoir 210 is greater than the predetermined level, the weight distribution of the ink reservoir 210 is toward the first side of the rotating portion 150, and the indicating unit 130 blocks the sensing unit 140. When the ink level of the ink reservoir 210 is less than the predetermined level, the weight distribution of the ink reservoir is toward the second side of the rotating portion 150, the indicating unit 130 is moved away from the sensing unit 140, and the warning unit emits the warning signal to alert a user that the ink level of the ink reservoir 210 is low.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An ink level detecting device rotationally coupled to an ink reservoir of an ink supply system and configured to detect an ink level of the ink reservoir, the ink level detecting device comprising:

a support for supporting the ink reservoir;

a rotating portion fixed to the support and configured to rotationally couple the ink reservoir to the support;

an indicating unit fixed to an outer surface of the ink reservoir and configured to rotate along with the ink reservoir; and a sensing unit corresponding to the indicating unit and configured to sense a change in position of the sensing unit; wherein:

when an ink level of the ink reservoir is greater than a predetermined level, a weight distribution of the ink reservoir and the ink is toward a first side of the rotating portion; and when the ink level of the ink reservoir is less than the predetermined level, the weight distribution of the ink reservoir and the ink is toward a second side of the rotating portion opposite to the first side.

2. The ink level detecting device of claim 1, further comprising a counterweight coupled to a bottom of the ink reservoir adjacent to the second side, wherein when the ink level of the ink reservoir is less than the predetermined level, the counterweight due to gravity rotates the ink reservoir toward the second side.

3. The ink level detecting device of claim 2, wherein the counterweight is hollow and coupled to the bottom of the ink reservoir; when the ink level of the ink reservoir is less than the predetermined level, the ink in the counterweight, due to gravity, rotates the ink reservoir toward the second side.

4. The ink level detecting device of claim 1, further comprising a base, wherein the support is fixed to an upper portion of the base.

5. The ink level detecting device of claim 1, wherein the sensing unit is a light blocking sensor; when the ink level is greater than the predetermined amount, a weight distribution of the ink reservoir and the ink is toward the first side of the rotating portion, and the indicating unit blocks the light blocking sensor; and when the ink level is less than the predetermined amount, the weight distribution of the ink reservoir and the ink is toward the second side of the rotating portion, and the indicating unit is moved away from the light blocking sensor.

6. An ink reservoir module comprising:

an ink reservoir for storing ink; and an ink level detecting device rotationally coupled to the ink reservoir and configured to detect an ink level of the ink reservoir, the ink level detecting device comprising:

a support for supporting the ink reservoir;

a rotating portion fixed to the support and configured to rotationally couple the ink reservoir to the support;

an indicating unit fixed to an outer surface of the ink reservoir and configured to rotate along with the ink reservoir; and a sensing unit corresponding to the indicating unit and configured to sense a change in position of the sensing unit; wherein:

when an ink level of the ink reservoir is greater than a predetermined level, a weight distribution of the ink reservoir and the ink is toward a first side of the rotating portion; and when the ink level of the ink reservoir is less than the predetermined level, the weight distribution of the ink reservoir and the ink is toward a second side of the rotating portion opposite to the first side.

7. The ink reservoir module of claim 6, wherein the ink level detecting device further comprises a counterweight coupled to a bottom of the ink reservoir adjacent to the second side, wherein when the ink level of the ink reservoir is less than the predetermined level, the counterweight due to gravity rotates the ink reservoir toward the second side.

8. The ink reservoir module of claim 7, wherein the counterweight is hollow and coupled to the bottom of the ink reservoir.

9. The ink reservoir module of claim 6, wherein the ink level detecting device further comprises a base, wherein the support is fixed to an upper portion of the base.

10. The ink reservoir module of claim 6, wherein the sensing unit is a light blocking sensor; when the ink level is greater than the predetermined amount, a weight distribution of the ink reservoir and the ink is toward the first side of the rotating portion, and the indicating unit blocks the light blocking sensor; and when the ink level is less than the predetermined amount, the weight distribution of the ink reservoir and the ink is toward the second side of the rotating portion, and the indicating unit is moved away from the light blocking sensor.

11. An ink supply system comprising:

an ink reservoir module comprising an ink reservoir and an ink level detecting device, the ink level detecting device rotationally coupled to the ink reservoir and configured to detect an ink level of the ink reservoir;

an ink supply line for coupling between the ink reservoir and a print head; and a controller in communication with the ink level detecting device, the ink level detecting device comprising:

a support for supporting the ink reservoir;

a rotating portion fixed to the support and configured to rotationally couple the ink reservoir to the support;

an indicating unit fixed to an outer surface of the ink reservoir and configured to rotate along with the ink reservoir; and a sensing unit corresponding to the indicating unit and configured to sense a change in position of the sensing unit;

wherein when an ink level of the ink reservoir is greater than a predetermined level, a weight distribution of the ink reservoir and the ink is toward a first side of the rotating portion; wherein:

when the ink level of the ink reservoir is less than the predetermined level, the weight distribution of the ink reservoir and the ink is toward a second side of the rotating portion opposite to the first side; and when the ink level of the ink reservoir is less than the predetermined amount, the controller turns off the print head.

12. The ink supply system of claim 11, wherein the ink level detecting device further comprises a counterweight coupled to a bottom of the ink reservoir adjacent to the second side, wherein when the ink level of the ink reservoir is less than the predetermined level, the counterweight due to gravity rotates the ink reservoir toward the second side.

13. The ink supply system of claim 12, wherein the counterweight is hollow and coupled to the bottom of the ink reservoir.

14. The ink supply system of claim 11, wherein the ink level detecting device further comprises a base, wherein the support is fixed to an upper portion of the base.

15. The ink supply system of claim 11, wherein the sensing unit is a light blocking sensor; when the ink level is greater than the predetermined amount, a weight distribution of the ink reservoir and the ink is toward the first side of the rotating portion, and the indicating unit blocks the light blocking sensor; and when the ink level is less than the predetermined amount, the weight distribution of the ink reservoir and the ink is toward the second side of the rotating portion, and the indicating unit is moved away from the light blocking sensor.

16. The ink supply system of claim 11, further comprising a stop unit, wherein when the ink level is greater than the predetermined amount, the weight distribution of the ink reservoir and the ink is toward the first side of the rotating portion and resists against the stop unit.

* * * * *